US006049062A

United States Patent [19]

Jones

[11] Patent Number: 6,049,062

[45] Date of Patent: Apr. 11, 2000

[54] HEATED GARMENT WITH TEMPERATURE CONTROL

[76] Inventor: Lawrence Alfred Jones, 163 Sammis Ave., Deer Park, N.Y. 11729

[21] Appl. No.: 09/249,755

[22] Filed: Feb. 16, 1999

[51] Int. Cl.[7] ..... H05B 3/34

[52] U.S. Cl. ..... 219/211; 429/127

[58] Field of Search ..... 219/211, 528, 219/529, 549; 320/2; 429/127

[56] References Cited

U.S. PATENT DOCUMENTS

| | | | |
|---|---|---|---|
| 2,798,896 | 7/1957 | Bly | 429/127 |
| 3,023,259 | 2/1962 | Coler | 136/6 |
| 3,778,590 | 12/1973 | Iizuka et al. | 219/211 |
| 3,999,037 | 12/1976 | Metcalf, Sr. | 219/211 |
| 4,273,989 | 6/1981 | Hinton | 219/211 |
| 4,665,308 | 5/1987 | Courvoisier et al. | 219/548 |
| 5,032,705 | 7/1991 | Batcheller et al. | 219/211 |
| 5,148,002 | 9/1992 | Kuo et al. | 219/211 |
| 5,302,807 | 4/1994 | Zhao | 219/211 |
| 5,486,680 | 1/1996 | Lieberman | 219/211 |
| 5,572,401 | 11/1996 | Carroll | 429/127 |
| 5,893,991 | 4/1999 | Newell | 219/211 |

FOREIGN PATENT DOCUMENTS

| | | |
|---|---|---|
| 287294 | 10/1988 | European Pat. Off. . |
| 2577390 | 8/1986 | France . |
| 9620618 | 7/1996 | WIPO . |

*Primary Examiner*—John A. Jeffery

[57] ABSTRACT

A heated garment with temperature control includes a thermal garment adapted for being worn on a body of an individual. The thermal garment includes an interior liner. A heating element is disposed within the interior liner of the thermal garment. The heating element is disposed within a majority of an area of the thermal garment. At least one flexible rechargeable battery is disposed within the interior liner of the thermal garment. The flexible rechargeable battery is in communication with the heating element. A thermostat is disposed within the outer layer of the thermal garment and in communication with the heating element.

5 Claims, 2 Drawing Sheets

HEATED GARMENT WITH TEMPERATURE CONTROL

BACKGROUND OF THE INVENTION

The present invention relates to a heated garment with temperature control and more particularly pertains to heating the body of an individual.

All sorts of clothes on the market are generally divided into two categories: winter clothing and summer/spring clothing. During freezing winter conditions, no matter what clothes a person puts on, they are still extremely cold. The answer to this problem is to dress in layers. This solution often results in the person being weighted down with very limited range of motion. This limited range of motion often contributes to remaining cold due to lack of movement. Additionally, many people do not have access to, or storage for, the amount of clothes sometimes necessary in the cold winter months. The present invention seeks to provide a device that solves all of the aforementioned problems.

The use of garments with heating means is known in the prior art. More specifically, garments with heating means heretofore devised and utilized for the purpose of providing warmth to the body are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,486,680 to Lieberman discloses a flexible battery formed in the shape of a garment, used in conjunction with a heating element to warm various parts of the body while utilizing body heat to enhance electrochemical activity for the battery. U.S. Pat. No. 3,023,259 to Cole discloses a flexible battery, capable of being wrapped around a person, under their clothing, to maintain the operations of the battery under low temperature. U.S. Pat. No. 4,273,989 to Hinton discloses a battery powered thermal garment with recharging means. U.S. Pat. No. 5,302,807 to Zhao discloses an electrically heated garment with temperature control means.

While these devices fulfill their respective, particular objective and requirements, the aforementioned patents do not describe a heated garment with temperature control for heating the body of an individual.

In this respect, the heated garment with temperature control according to the present invention substantially departs from the conventional concepts and designs of the prior art, and in doing so provides an apparatus primarily developed for the purpose of heating the body of an individual.

Therefore, it can be appreciated that there exists a continuing need for new and improved heated garment with temperature control which can be used for heating the body of an individual. In this regard, the present invention substantially fulfills this need.

SUMMARY OF THE INVENTION

In the view of the foregoing disadvantages inherent in the known types of garments with heating means now present in the prior art, the present invention provides an improved heated garment with temperature control. As such, the general purpose of the present invention, which will be described subsequently in greater detail, is to provide a new and improved heated garment with temperature control and method which has all the advantages of the prior art and none of the disadvantages.

To attain this, the present invention essentially comprises a thermal garment adapted for being worn on a body of an individual. The thermal garment includes an interior liner. A heating element is disposed within the interior liner of the thermal garment. The heating element is disposed within a majority of an area of the thermal garment. At least one flexible rechargeable battery is disposed within the interior liner of the thermal garment. The flexible rechargeable battery is in communication with the heating element. The battery has a recharge port disposed outwardly with respect to an outer layer of the thermal garment. A recharging cord is provided having a first end adapted for being received within the recharge port and a second end adapted for coupling with an electrical outlet. A thermostat is disposed within the outer layer of the thermal garment and in communication with the heating element.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved heated garment with temperature control which has all the advantages of the prior art garments with heating means and none of the disadvantages.

It is another object of the present invention to provide a new and improved heated garment with temperature control which may be easily and efficiently manufactured and marketed.

It is a further object of the present invention to provide a new and improved heated garment with temperature control which is of durable and reliable construction.

An even further object of the present invention is to provide a new and improved heated garment with temperature control which is susceptible of a low cost of manufacture with regard to both materials and labor, and which accordingly is then susceptible of low prices of sale to the consuming public, thereby making such a heated garment with temperature control economically available to the buying public.

Even still another object of the present invention is to provide a new and improved heated garment with temperature control for heating the body of an individual.

Lastly, it is an object of the present invention to provide a new and improved heated garment with temperature control including a thermal garment adapted for being worn on a body of an individual. The thermal garment includes an interior liner. A heating element is disposed within the interior liner of the thermal garment. The heating element is disposed within a majority of an area of the thermal garment. At least one flexible rechargeable battery is disposed within the interior liner of the thermal garment. The flexible rechargeable battery is in communication with the heating element. A thermostat is disposed within the outer layer of the thermal garment and in communication with the heating element.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
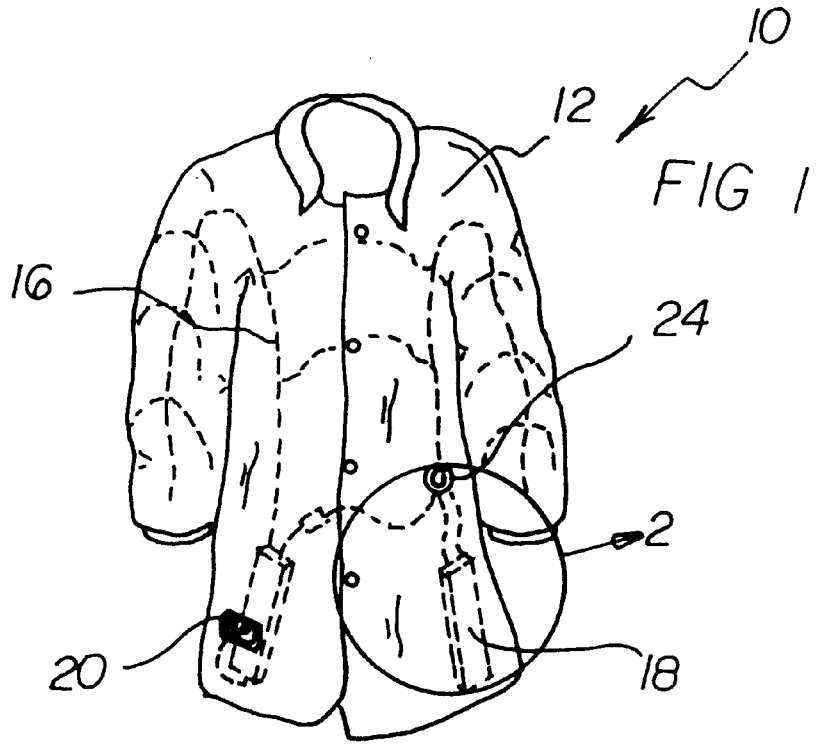
FIG. 1 is a perspective view of the preferred embodiment of the heated garment with temperature control constructed in accordance with the principles of the present invention.
Figure 2:
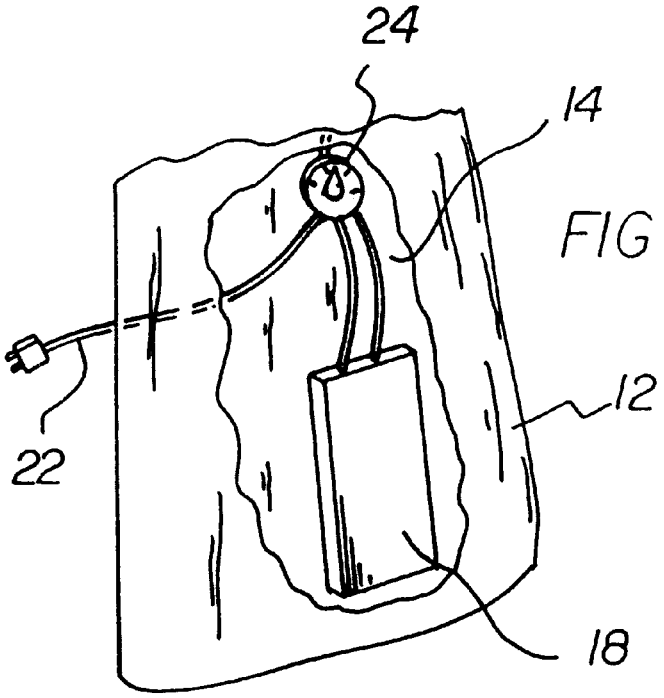
FIG. 2 is a sectional perspective view of the flexible battery and thermostat of the present invention as taken from circle 2 of FIG. 1.

With reference now to the drawings, and in particular, to FIGS. 1 through 4 thereof, the preferred embodiment of the new and improved heated garment with temperature control embodying the principles and concepts of the present invention and generally designated by the reference number 10 will be described.

Specifically, it will be noted in the various FIGS. that the device relates to a heated garment with temperature control for heating the body of an individual. In its broadest context, the device consists of a thermal garment, a heating element, a flexible rechargeable battery, a recharging cord, and a thermostat. Such components are individually configured and correlated with respect to each other so as to attain the desired objective.

The thermal garment 12 is adapted for being worn on a body of an individual. The thermal garment 12 includes an interior liner 14. The thermal garment 12 could be a coat, as illustrate in FIG. 1, or any other garment, such as pants, a shirt, a hat, a pair of gloves, etc.

The heating element 16 is disposed within the interior liner 14 of the thermal garment 12. The heating element 16 is disposed within a majority of an area of the thermal garment 12. Note FIGS. 1 and 3.

The flexible rechargeable battery 18 is disposed within the interior liner 14 of the thermal garment 12. The flexible rechargeable battery 18 is in communication with the heating element 16. The battery 18 has a recharge port 20 disposed outwardly with respect to an outer layer of the thermal garment 12. The number of batteries 18 depends on the number of sections of heating elements 16 used.

The recharging cord 22 has a first end adapted for being received within the recharge port 20 and a second end adapted for coupling with an electrical outlet.

The thermostat 24 is disposed within the outer layer of the thermal garment 12 and in communication with the heating element 16. The thermostat 24 can be used to adjust the degree that the heating element 16 is charged to control the internal temperature of the garment 12.

Figure 3:
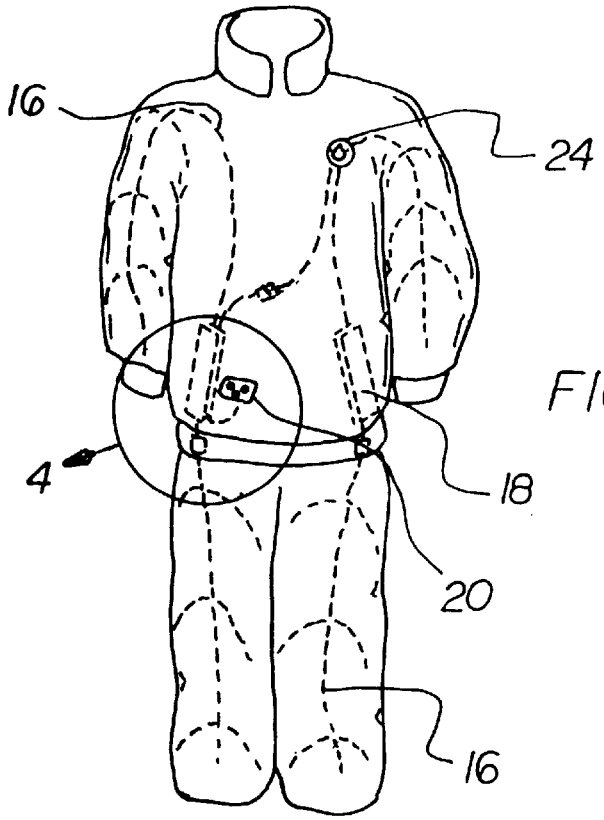
FIG. 3 is a front view of the present invention illustrated in a fully body garment.
Figure 4:
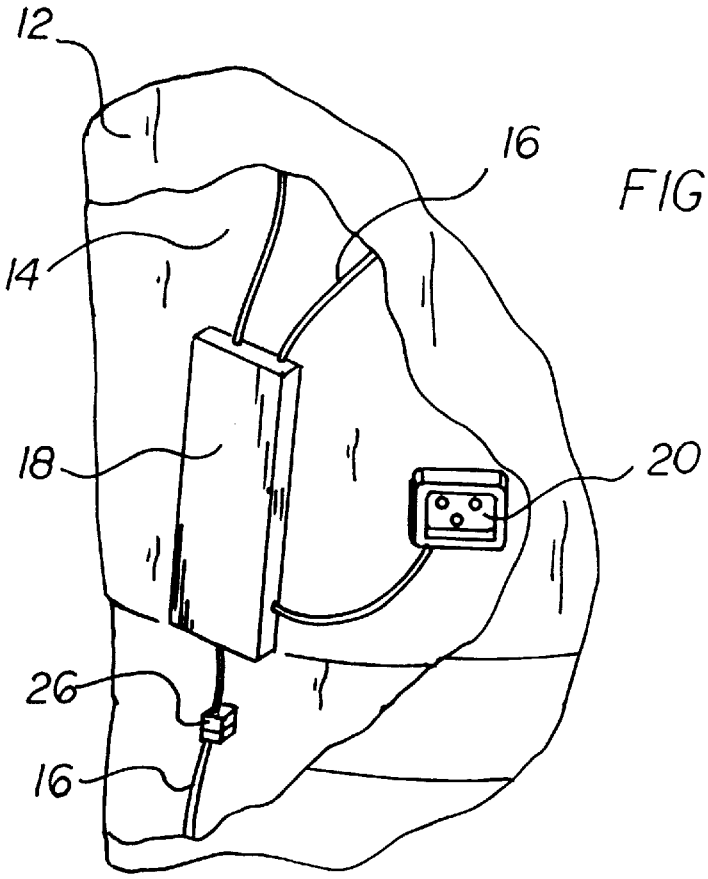
FIG. 4 is a sectional perspective view of the flexible battery and recharge port thereof as taken from circle 4 of FIG. 3.

FIGS. 3 and 4 illustrate the thermal garment as comprised of an upper portion and a lower portion. The heating element 16 is disposed within each of the upper portion and the lower portion with a separable connector 26 disposed between the heating element 16 of the upper portion and the heating element 16 of the lower portion.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A heated garment with temperature control for heating the body of an individual comprising, in combination:

a thermal garment adapted for being worn on a body of an individual, the thermal garment including an interior liner;

a heating element disposed within the interior liner of the thermal garment, the heating element being disposed within a majority of an area of the thermal garment;

at least one flexible rechargeable battery disposed within the interior liner of the thermal garment, the flexible rechargeable battery being in communication with the heating element;

a thermostat disposed within the outer layer of the thermal garment and in communication with the heating element.

2. The heated garment with temperature control as set forth in claim 1 wherein the flexible rechargeable battery has a recharge port disposed outwardly with respect to an outer layer of the thermal garment.

3. The heated garment with temperature control as set forth in claim 2 and further including a recharging cord having a first end adapted for being received within the recharge port and a second end adapted for coupling with an electrical outlet.

4. The heated garment with temperature control as set forth in claim 1 wherein the thermal garment is comprised of an upper portion and a lower portion, whereby the heating element is disposed within each of the upper portion and the lower portion with a separable connector disposed between the heating element of the upper portion and the heating element of the lower portion.

5. A heated garment with temperature control for heating the body of an individual comprising, in combination:

a thermal garment adapted for being worn on a body of an individual, the thermal garment including an interior liner;

a heating element disposed within the interior liner of the thermal garment, the heating element being disposed within a majority of an area of the thermal garment;

at least one flexible rechargeable battery disposed within the interior liner of the thermal garment, the flexible rechargeable battery being in communication with the heating element, the battery having a recharge port disposed outwardly with respect to an outer layer of the thermal garment;

a recharging cord having a first end adapted for being received within the recharge port and a second end adapted for coupling with an electrical outlet;

a thermostat disposed within the outer layer of the thermal garment and in communication with the heating element.

* * * * *